US005210524A

United States Patent [19]

Schwarz et al.

[11] Patent Number: 5,210,524

[45] Date of Patent: May 11, 1993

[54] ELECTRO-MAGNETIC DESENSITIZER

[75] Inventors: Werner Schwarz; Josef Graessle, both of Nuess, Fed. Rep. of Germany

[73] Assignee: Minnesota Mining and Manufacturing Company, St. Paul, Minn.

[21] Appl. No.: 697,644

[22] Filed: May 8, 1991

[30] Foreign Application Priority Data

May 16, 1990 [DE] Fed. Rep. of Germany ..... 4015779

[51] Int. Cl.[5] ..... G08B 13/24

[52] U.S. Cl. ..... 340/551; 340/572

[58] Field of Search ..... 340/551, 572, 515, 538, 340/310 R, 310 A, 693; 335/284; 324/228

[56] References Cited

U.S. PATENT DOCUMENTS

| | | | |
|---|---|---|---|
| 3,820,104 | 6/1974 | Fearon | 340/572 |
| 4,484,184 | 11/1984 | Gregor et al. | 340/572 |
| 4,906,974 | 3/1990 | Rehder | 340/551 |
| 5,027,106 | 6/1991 | Lizzi et al. | 340/572 |

FOREIGN PATENT DOCUMENTS

| | | | |
|---|---|---|---|
| 3014667 | 10/1981 | Fed. Rep. of Germany . | |
| 3015811 | 10/1981 | Fed. Rep. of Germany | 340/572 |
| 3045703 | 7/1982 | Fed. Rep. of Germany | 340/572 |

*Primary Examiner*—Thomas J. Mullen, Jr.

*Attorney, Agent, or Firm*—Gary L. Griswold; Walter N. Kirn; William B. Barte

[57] ABSTRACT

The invention is related to a process of deactivating a magnetic security marker of an article surveillance system, wherein the security marker is detected by simulating conditions normally present in such a system, e.g., by creating between a transmitter and a receiver a sine-wave electromagnetic field and the deactivating the security marker by means of the electronically switchable magnetizing apparatus in response to the detection of the magnetic field which corresponds to the magnetization of the security marker in the surveillance zone. It is the object of the invention to enable the magnetic security marker to be deactivated using any alternating power line. To this end, the magnetic system is automatically connected to a power line without circuit change when the security marker is detected. The magnetizing apparatus gradually builds up a magnetic field by rectifying the flow current, monitoring it by a current sensor and increasing it at each change of phase until the current reaches a level to which the sensor is set as effecting deactivation. Thereafter, the magnetizing apparatus is electronically disconnected from the power line.

11 Claims, 4 Drawing Sheets

ELECTRO-MAGNETIC DESENSITIZER

BACKGROUND OF THE INVENTION

1. Field of the Invention

The invention relates to a process for use with a companion electronic article surveillance (EAS) system. The inventive process detects and magnetizes a magnetic security marker of the EAS system.

The invention relates further to apparatus for practicing the aforesaid process.

2. Prior Art

U.S. Pat. No. 3,820,104 discloses a process of the aforesaid kind whereby a magnetic security marker particularly for anti-pilferage systems may be detected within a detection zone and deactivated thereafter, with the fact of such deactivation having taken place being signalled. The prior art process deactivates the magnetic security marker by magnetizing an element therein. The magnetizing field is preferably produced by discharging a capacitor having a very high capacitance into a coil. The process requires a very high voltage since it would not be possible otherwise to furnish the required current for two successive deactivation pulses at an acceptable repetition rate. This also calls for a voluminous and relatively expensive capacitor discharge circuit to be incorporated in the apparatus for practicing the said process.

It has been known also to provide apparatus for detecting and deactivating a security strip attached to an article of merchandise (DE-OS 30 45 703) which comprises a chamber having at least an input and an output opening for receiving the articles, as well as interrogation, detection and deactivation coils surrounding said chamber which when coupled to the associated power source are energized to generate an electromagnetic field which permeates the said chamber.

DE-OS 30 14 667, too, discloses a process and apparatus for deactivating a security marker much like that described in the U.S. Pat. No. 3,820,104.

In both of the disclosures, the security marker comprises a strip of magnetically soft (low coercive force) high-permeability material together with at least one piece of a second material having a higher coercive force which in the demagnetized condition is neutral relative to and does not affect the magnetically soft strip so that in this condition the security marker will be activated, meaning that the detection means will detect a characteristic response produced by the marker when an article having the marker attached thereto passes through the surveillance zone.

In order to deactivate the security marker (e.g. when the merchandise has been paid for), the deactivator magnetizes the higher coercive force material and causes the high-permeability element to saturate so that the characteristic response on which detection is based is no longer produced.

When using a deactivator in the form of a coil, the associated field magnetizes a continuous strip of the magnetizable material into a single one-piece bar magnet since the magnetic field lines will be short-circuited in the latter and be prevented from extending sufficiently through the material of a high-permeability material. As a result, there is not acceptable safety that the high-permeability strip be saturated to the point where it cannot respond to an alternating magnetic field in the surveillance zone. In order to prevent this from happening, the process known by DE-OS 30 14 667 depicts apparatus for forming adjacent poles of different polarity in the magnetic security marker by moving the marker into the active region of a deactivator which has adjacent poles of different polarity. The deactivator and reactivator for the magnetizable security marker used there disclosed comprises alternating polarity magnetic poles serially spaced on a mount. The distance between said poles are selected to correspond to the desired depth of penetration of the magnetic field generated between adjacent poles, and each pole has a deactivation coil wound thereon, with adjacent coils being serially connected and wound in opposite directions so that a current passed therethrough causes webs in the mounting structure, which forms the poles, to act alternatingly as north poles and south poles.

The prior process and apparatus according to DE-OS 30 14 667 are unable to determine safely whether the security element has in fact been demagnetized or deactivated.

SUMMARY OF THE INVENTION

It is the object underlying the invention to provide a process of the kind stated above as well as apparatus for practicing said process which enable magnetizable elements in the magnetic security markers to be magnetized safely using any alternating current power supply, thereby deactivating the markers.

In accordance with the invention, this object is achieved by the inventive features stated in the characterizing portion of patent claim 1.

In particular, the inventive apparatus for practicing the process is characterized by the features stated in the characterizing portion of patent claim 2.

Patent claims 3 to 12 teach advantageous further developments of the inventive apparatus.

By means of this invention it is possible to accurately determine whether a security marker used in the anti-pilferage system has in fact been deactivated (desensitized) electromagnetically (e.g. in the cash register region).

The electronic article surveillance (EAS) system with which the deactivating apparatus of the present invention is to be used, basically corresponds in function to an anti-pilferage system of the kind frequently used at the exits of department stores, libraries etc. In such a system, a transmitter generates an alternating signal which may for example have a frequency of one kilohertz. The alternating signal is in turn coupled via a power amplifier and a capacitor to a coil positioned adjacent an interrogation zone. Signals produced by markers in the zone are received by a receiver coil also positioned adjacent the interrogation zone. The second signals are passed to a bank of bandpass filters or the like, which allow a characteristic response at the security marker to be identified. The security markers are formed magnetically in such a manner that the characteristic response includes a characteristic frequency spectrum which is readily identified and distinguished from other influences.

More specifically, the apparatus of the present invention comprises equipment which simulates that of the electronic article surveillance system with which it is to operate. Thus the simulation equipment comprises a wave generator and coil, for generating a first magnetic field corresponding to that produced by the EAS system for interrogating a said marker, within which first field a said marker may be positioned. The equipment further comprises a receiver for detecting the response from the marker and for producing an active marker signal in the event the response corresponds with the characteristic response required by the EAS system to produce the alarm signal. Additionally, the apparatus also comprises a circuit for generating within the coil a second, unidirectional magnetic field, which causes the magnetizable element of the marker to change the magnetic state thereof, thereby altering said response, and a circuit for reapplying the first magnetic field to the marker, detecting the response therefrom and for producing a deactivated marker signal when said altered response is detected.

The apparatus is characterized by an electronic switch responsive to the active marker signal for automatically applying current directly from a source of alternating electrical power through a rectifier to the coil to gradually build up the second, directionally constant magnetic field. The current through the coil is sensed and electronic evaluator and control circuits 17 and 18, respectively, respond to the sensed current so that when the current level is reached at which the intensity of the second field corresponds to that level at which the characteristic response will be altered, the switch means automatically disconnects the source of electrical power from the coil.

In operation, as soon as the security marker is detected, the coil is automatically connected through a rectifier, without any circuitry change, to an alternating power line (100 to 260 volts, 50 to 60 Hz). This directionally constant current, monitored by the current sensor, causes a directionally constant magnetic field to be set up, and is increased at each change of phase until a current is reached, at which the resultant magnetic field causes deactivation to take place, such current being adjusted by means of the current sensor.

The resultant currents are on the order of several amperes. The last one of the direct current pulses building up to reach the magnetic field strengths having a flux density required for deactivating, i.e., magnetizing, the magnetic security marker may require a current of 14 amperes, as it is desirable to set the current to a maximum current level corresponding to a magnetic flux density amounting to three times the magnetic flux density required for activation. Depending on the marker intended to be used, such a flux density may desirably be in the range of 300–1000 G (30–100 mT (milli-Tesla)).

Instead of the bank of bandpass filters coupled to the receiver antenna output, the antenna output signal may preferably be digitized and processed by a signal processor.

The apparatus of the present invention is particularly used in connection with security markers which need a directionally constant magnetic field for desensitization. However, it is also recognized that the apparatus may also produce an alternating magnetic field, gradually decreasing in intensity, by applying current directly from the alternating current grid, without being rectified, thereby resensitizing the marker by demagnetizing the magnetizable element therein.

The inventive process and the apparatus for practicing it are advantageous particularly because a magnetic security marker may be activated or deactivated using any AC power line. Detection errors due to label dyes, contamination, print or orientation are not possible. In particular, the use of the electromagnetic coil for both the detection of the security marker and its deactivation is advantageous because the same field orientation provides for 100% deactivation. Since the electromagnetic coil of the magnetizing apparatus is energized by a mains voltage, power may be obtained easily and reliably as transformers, capacitors, high current thyristors and the like will not be necessary. The relatively low frequency of 1 kHz obviates problems with postal or other communications authorities. As the maximum distance that the security marker may be detected by the inventive apparatus is equal to one-half the distance from the apparatus at which it can be deactivated, and as the time required to generate the magnetic field is very short (80–100 ms), the deactivation is 100 percent user reliable. Additionally, after the magnetization process has been completed, a test is immediately carried out to establish whether or not an active security marker is in the detection area. In addition, the electromagnetic coil is only activated for a relatively short time in the deactivation process; this prevents magnetic media from being accidentally erased. The inventive apparatus is easily handled by unskilled personnel and may be used together with any magnetic security marker.

The invention eliminates the previous necessity of using a bank of capacitors having a relatively high capacity, transformers and high current thyristors; in addition, it allows the magnetic system to be switched to the main power line in response to a detection of the security marker without circuitry changes. As a result, relatively high current intensities as well as different coil assemblies may be used so that the security marker does not have to be located in an area of maximum magnetic field strength. It is possible to use a conventional coil and to mount it on a core preferrably made of transformer steel sheets. The core may be U-shaped and the electromagnetic coil may be mounted on its central portion, with the two legs of the yoke as high as the coil to create a relatively large air gap. Together with the coil, the core may advantageously be mounted under the top e.g. of a cash register table so that all an operator has to do is to simply move an item of merchandize bearing the security element across the table top.

Alternatively, the coil and the yoke may be mounted in a handheld unit.

BRIEF DESCRIPTION OF THE DRAWING

The invention will now be explained in great detail under reference to the attached drawings.

DETAILED DESCRIPTION

Figure 1:
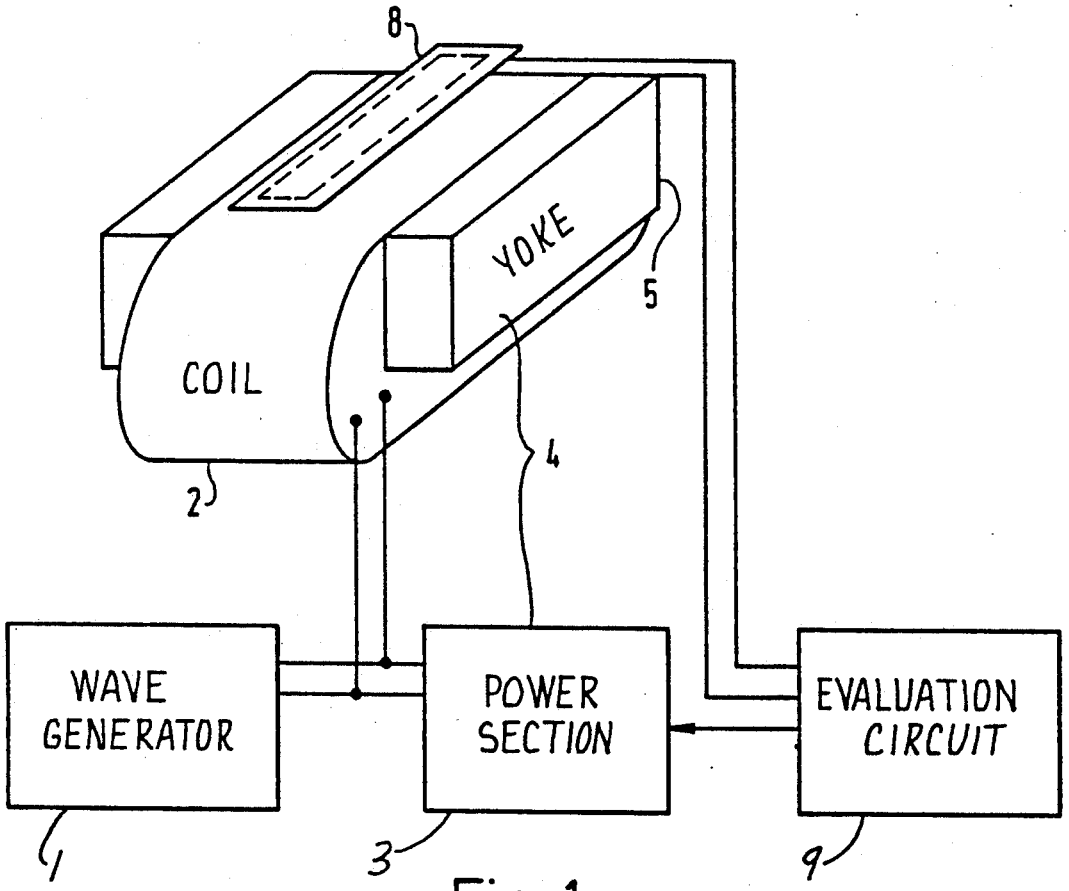
FIG. 1 shows the fundamental elements of the inventive apparatus.
Figure 3:
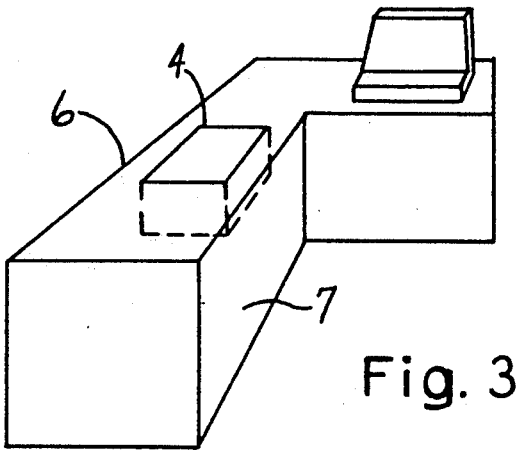
FIG. 3 shows a perspective view of a cash register table having the inventive apparatus mounted thereunder.

As shown in FIG. 1, the inventive apparatus has on the transmitter side a wave generator 1 which typically generates a 1 kHz sinewave signal and is coupled to an electromagnetic coil 2 of deactivator 4 and to a power section 3. Coil 2 enables magnetic fields to be generated which are strong enough to deactivate a security marker in the system. A yoke 5 having a typical U-shape and made of transformer steel sheets may be provided inside coil 2. The legs of yoke 5 may fill the top of coil 2 to concentrate the magnetic field at the top of coil 2. Together with coil 2, yoke 5 may be mounted under top 6 of e.g. a cash register table 7 (FIG. 3). The receiver comprises an antenna 8 mounted atop coil 2 and coupled to electronic evaluation circuit 9, which also acts to drive power section 3, of magnetizing apparatus 4.

The (short-circuited) cylinder coil 2, the yoke 5 and the power section 3 together from said magnetizing apparatus 4 which preferably is mounted under a table top 7 (FIG. 3) or in a handheld unit.

Figure 2:
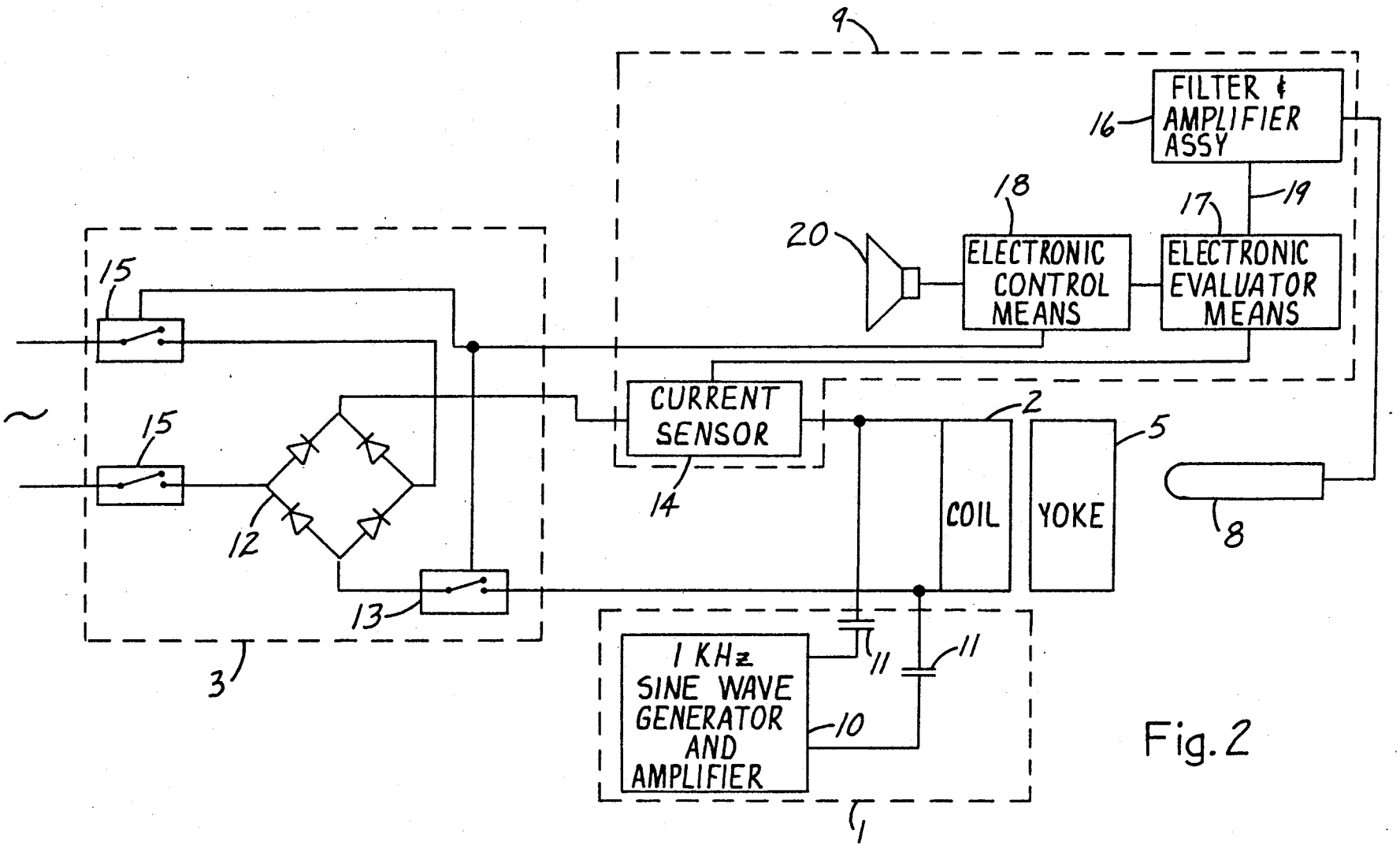
FIG. 2 shows a presently preferred circuit arrangement of the apparatus for practicing the inventive process.

As shown in FIG. 2, which shows the circuitry in accordance with a preferred embodiment of the inventive apparatus, wave generator 1 is made of a sinewave generator 10 and capacitors 11, and coupled through said capacitors 11 to the terminals of coil 2 of yoke 5 of magnetizing apparatus 4.

Cylinder coil 2 is short-circuited via a fullwave bridge rectifier 12, with one branch of the short-circuit connection including between the junction of the respective capacitor 11 and fullwave bridge rectifier 12 a series connection of a switch 13 and a current sensor 14. Through switches 15, fullwave bridge rectifier 12 may be connected directly to any alternating power line (100 to 260 V, 50 to 60 Hz).

Fullwave bridge rectifier 12, switch 13 in the short-circuit loop and switch 15 are combined to form the power section 3 of the magnetizing apparatus 4.

On the receiver side, system antenna 8 is connected via filter and amplifier assembly 16 with an electronic evaluator means 17 connected in series with an electronic control means 18. Output 19 of filter and amplifier assembly 16 is coupled to said electronic evaluator means 17. The output of electronic control means 18 is connected to acoustic signalling means 20. Evaluator means 17 controls switch 15 to the AC power line and also switch 13 in the short-circuit loop. The reset input of control means 18 is directly coupled to switch 13 and one of the switches 15. The reset input of evaluator means 17 will be actuated by the current sensor 14, if the magnetic security marker is detected, e.g. the sold goods are moved over the table top, the magnetic system will be directly connected to the power line which creates a successively increasing magnetic field. For that, the current will be rectified in double bridge 12 and current sensor 14 in the short circuit loop will control the current. The current will be increased at every phase change, until the trigger level of current sensor 14 is reached. That guarantees that the magnetic flux density was strong enough to deactivate the security marker.

When the necessary coil current from the current sensor 14 is reached, reset input of the evaluator means 17 is actuated and switches off switches 13 and 15 and simultaneously switches on acoustic signalling means 20 for 0,5 s. Since switches 13 and 15 are thyristors, the power line will be switched off at the next phase change. The short circuit loop switch 13 remains activated until the coil current is practically zero (max. 0,5 s).

Current sensor 14, filter and amplifier assembly 16, electronic evaluator and control means 17 and 18 and the acoustic signalling means 20 are combined to form the electronic analyzer (comparator) 9 (also shown in FIG. 1) used to control power section 3.

Alternatively, coil 2 of the magnetic system may be preferably short-circuited by antiparallel diodes connected to the power line via a diode, with the current sensor 14 coupled to the electronic switch included in the short-circuit loop.

Figure 4:
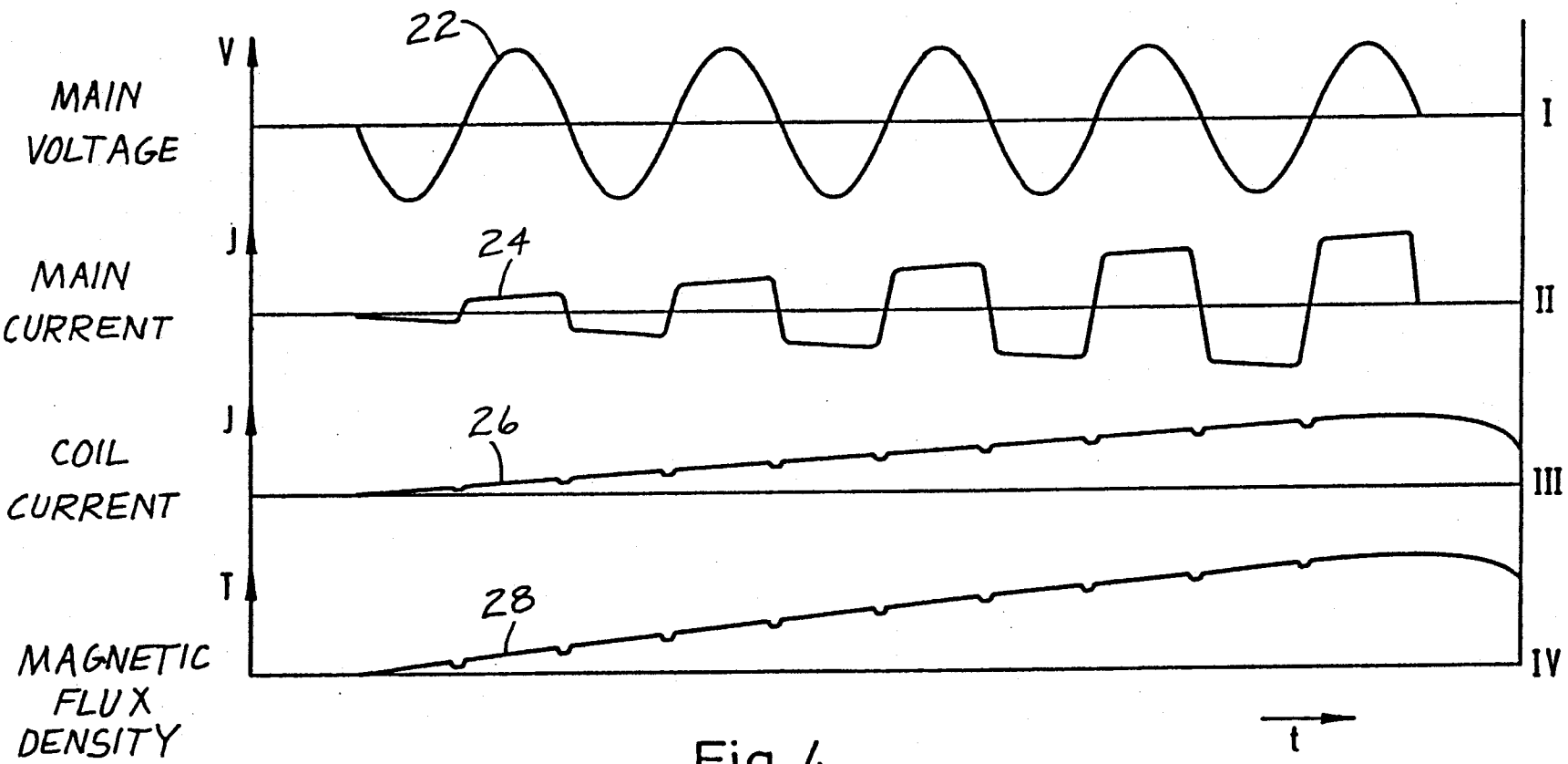
FIG. 4 shows diagrams illustrating the main voltage, the main current, the coil current and the magnetic flux density as they occur in the practice of the inventive process.

As shown by diagram I in FIG. 4, connection of the apparatus to the alternating power line causes a sinewave voltage 22 to be applied to fullwave bridge rectifier 12, which causes the current 24 to be rectified as shown in diagram II of FIG. 4 thereby providing a plurality of rectified voltage pulses. The high-impedance magnetic system causes the waveform of the increasing current 26 to deviate substantially from a pure sine. Diagram III of FIG. 4 shows the rectified current flowing through coil 2 of magnetizing apparatus 4, which increases in steps and is substantially smoothed by the high impedance of coil 2. Although the curve of the rectified current extends to zero, this current function is not transferred to the coil, because these intermissions in the power flux are bridged relatively easily by the magnetic system. Accordingly, and as shown in diagram IV of FIG. 4, the system builds up a steadily increasing magnetic flux density 28. In the example shown, this takes about 100 milliseconds, assuming a power line frequency of 50 Hz. Further, diagrams III and IV show that, once the maximum current (i.e. the current to which current sensor 14 is set to respond) and the corresponding magnetic flux density (typically 800 G, 80 mT (milli Tesla)) have been reached, the magnetic system is disconnected from power line by the electronic switch 15. Following the disconnection of the magnetic system from power line, the magnetic field disappears within 0,5 s.

Figure 5:
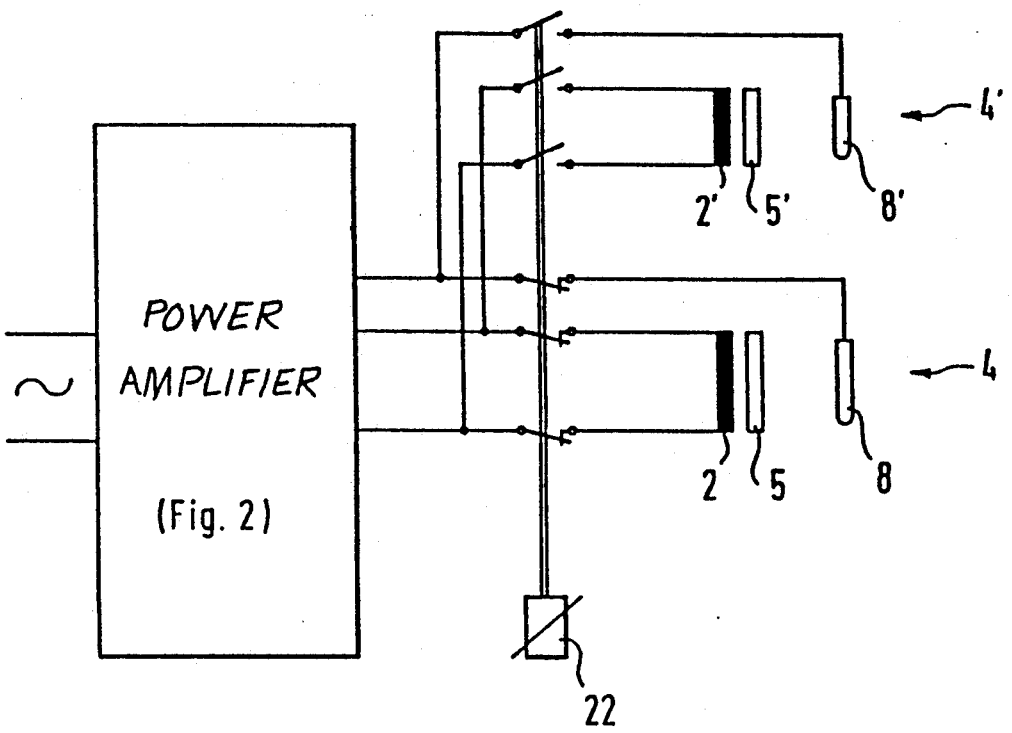
FIG. 5 shows the circuitry of the magnetizing apparatus per se which is mounted under the top of a cash register table or in a handheld unit.

FIG. 5 shows the circuitry of the magnetizing apparatus 4 or 4' with coil 2, yoke 5 and antenna 8 being mounted under a table top, whereas coil 2', yoke 5' and antenna 8' are mounted in a handheld unit. By means of switch 22 the operation of the inventive apparatus can be changed either to the table top device or to the handheld unit.

What is claimed is:

1. A method for magnetizing a magnetically responsive marker of an electronic article surveillance system in which an alternating magnetic field is produced within an interrogation zone for interrogating a said marker and a characteristic response produced by an activated marker in said zone is detected and used to produce an appropriate alarm signal, said marker comprising at least one magnetizable element which, when magnetized, causes a different response to be produced than that resulting when the magnetizable element is unmagnetized, said method comprising the steps of a) positioning a said marker proximate to a coil and thus within a first magnetic field produced by said coil which corresponds to that produced by said system for interrogating a said marker, detecting the response from the marker and producing an active marker signal in the event the response corresponds with the characteristic response required by the system to produce a said alarm signal, b) applying a second magnetic field identified by its flux density to said magnetizable element to change the magnetic state thereof, thereby altering said response, and c) applying said first magnetic field to said marker, detecting the response therefrom and producing a deactivated marker signal when said altered response is detected, said method being characterized by the steps of responding to a said active marker signal by automatically closing a switch so as to apply a source of alternating electrical current via a rectifier to said coil to gradually build up said second magnetic field, which is directionally constant, sensing said current and using said sensed current to drive electronic control means to increase said current until a current level is reached corresponding to a magnetic field intensity level at which said characteristic response will be altered, and automatically opening said switch to disconnect the current from the coil when said current level is reached.

2. A deactivating apparatus for magnetizing a magnetically responsive marker of an electronic article surveillance system, said system comprising means for producing within an interrogation zone an alternating magnetic field for interrogating a said marker and means for producing an appropriate alarm signal when a characteristic response produced by an activated marker in said zone is detected, said marker comprising at least one magnetizable element which, when magnetized, causes a different response to be produced than that resulting when the magnetizable element is unmagnetized, said deactivating apparatus comprising a) electronic article surveillance system simulation means comprising a wave generatior (1), a coil (2) for generating a first magnetic field corresponding to that produced by said system for interrogating said marker, within which first field said marker may be positioned, means (8, 16) for detecting the response from the marker and for producing an active marker signal in the event the response corresponds with the characteristic response required by the system to produce a said alarm signal, b) means (3) for generating within said coil a second magnetic field identified by its flux density, and for applying said second field to said magnetizable element to change the magnetic state thereof, thereby altering said response, and c) means (9) for applying a said first magnetic field to said marker, detecting the response therefrom and means (20) for producing a deactivated marker signal when said altered response is detected, said apparatus being characterized by electronic switch means (13, 15) responsive to said active marker signal for automatically and gradually applying current through a rectifier means (12) directly from a source of alternating electrical power to said coil to gradually build up said second magnetic field, which is directionally constant, means (14) for sensing the current in said coil, electronic evaluator means (17) for responding when said sensed current reaches a current level at which the intensity of said second magnetic field corresponds to that level at which said characteristic response will be altered, and electronic control means (18) for automatically opening said switch means (13, 15) to disconnect the source of alternating electrical power from the coil when the intensity of said second magnetic field is sufficient to alter said response.

3. An apparatus according to claim 2, wherein said wave generator (1) generates a substantially sinusoidal first magnetic field.

4. An apparatus as in claim 3, characterized in that both terminals of said coil (2) are connected through impedance matching and decoupling capacitors (11) to said wave generator (1), and in that said switch means (13) prevents current from said wave generator from being short-circuited.

5. An apparatus according to claim 2, further including a yoke (5) of ferromagnetic material proximate to said coil and wherein said rectifier means comprises a full wave bridge rectifier (12) connected directly to said source of electrical power and short-circuiting said coil, with said current sensing means (14) and a portion (13) of said electronic switch means being connected in series in said short-circuit.

6. An apparatus as in claim 5, characterized by said yoke (5) being configured to create a relatively wide air gap, with the yoke (5) and coil (2) being adapted to be mounted underneath a table top (6).

7. An apparatus as in claim 5, characterized by said yoke (5) having a substantially U-shaped configuration such that the magnetic flux density required for deactivating the magnetic marker is provided outside of said U-shaped configuration.

8. An apparatus as in claim 2, characterized by the magnetic flux density required for deactivating the magnetic marker being built up by a plurality of rectified voltage pulses from the source of electrical power.

9. An apparatus as in claim 2, characterized by said current sensing means being set to respond to a maximum current level corresponding to a magnetic flux density amounting to three times the magnetic flux density required for deactivation.

10. An apparatus according to claim 2, characterized in that said current sensing means is set to respond to a maximum current level corresponding to a magnetic flux density in the range of 300 to 1000 G (30–100 mT (milli-Tesla)).

11. An apparatus as in claim 2; characterized by a yoke (5) proximate to said coil (2) consisting of a relatively low coercive force material.

* * * * *